US010124352B2

(12) United States Patent
Ueno et al.

(10) Patent No.: US 10,124,352 B2
(45) Date of Patent: Nov. 13, 2018

(54) ELECTROSTATIC COATING DEVICE, POWER SOURCE DEVICE FOR ELECTROSTATIC COATING DEVICE AND ELECTROSTATIC COATING METHOD

(71) Applicant: NAGASE TECHNO-ENGINEERING CO., LTD., Tokyo (JP)

(72) Inventors: Tsutomu Ueno, Kanagawa (JP); Katsuhiro Sato, Kanagawa (JP)

(73) Assignee: Nagase Techno-Engineering Co., Ltd., Tokyo (JP)

( * ) Notice: Subject to any disclaimer, the term of this patent is extended or adjusted under 35 U.S.C. 154(b) by 0 days.

(21) Appl. No.: 15/301,106

(22) PCT Filed: Mar. 25, 2015

(86) PCT No.: PCT/JP2015/059204
§ 371 (c)(1),
(2) Date: Sep. 30, 2016

(87) PCT Pub. No.: WO2015/151970
PCT Pub. Date: Oct. 8, 2015

(65) Prior Publication Data

US 2017/0014840 A1 Jan. 19, 2017

(30) Foreign Application Priority Data

Mar. 31, 2014 (JP) ..... 2014-072181

(51) Int. Cl.
*B05B 5/053* (2006.01)
*B05B 5/025* (2006.01)
(Continued)

(52) U.S. Cl.
CPC ..... *B05B 5/0533* (2013.01); *B05B 5/025* (2013.01); *B05B 5/1608* (2013.01); *B05D 1/06* (2013.01); *B05B 13/0235* (2013.01)

(58) Field of Classification Search
CPC ... B05B 13/0235; B05B 5/025; B05B 5/0533; B05B 5/1608; B05D 1/06; B05D 1/007
See application file for complete search history.

(56) References Cited

U.S. PATENT DOCUMENTS 6,481,833 B1 * 11/2002 Fujii ..... B41J 2/04525 347/68
2003/0179264 A1 * 9/2003 Yamada ..... B41J 2/06 347/48
2007/0089762 A1 4/2007 Baumann et al.

FOREIGN PATENT DOCUMENTS

JP H08-323248 A 12/1996
JP H10-34027 A 2/1998
(Continued)

OTHER PUBLICATIONS

International Search Report for corresponding International Application No. # PCT/JP2015/059204, dated Jun. 23, 2015 (2 pages).
(Continued)

*Primary Examiner* — Alexander M Weddle
(74) *Attorney, Agent, or Firm* — Osha Liang LLP

(57) ABSTRACT

An electrostatic coating device comprising a nozzle section that discharges a liquid to a substrate, a counter electrode that is disposed in such a way as to face the nozzle section and supports the substrate and a power source device that applies a voltage between the nozzle section and the counter electrode further comprises an instantaneous stop circuit that selectively grounds the nozzle section. When the nozzle section is grounded by the instantaneous stop circuit, a charge remaining in the nozzle section goes to the ground and the charge remaining in the nozzle section disappears. For this reason, after the power source device is turned off, dripping of the liquid from the nozzle section can be completed as quickly as possible.

3 Claims, 3 Drawing Sheets

(51) Int. Cl.

| | |
|---|---|
| ***B05B 5/16*** | (2006.01) |
| ***B05D 1/06*** | (2006.01) |
| *B05B 13/02* | (2006.01) |

(56) References Cited

FOREIGN PATENT DOCUMENTS

| | | | | |
|---|---|---|---|---|
| JP | 2004-136655 | A | | 5/2004 |
| JP | 2006-058628 | A | | 3/2006 |
| JP | 2008-043944 | A | | 2/2008 |
| JP | 2009-202131 | A | | 9/2009 |
| JP | 2009202131 | A | * | 9/2009 |

OTHER PUBLICATIONS

International Preliminary Report on Patentability for corresponding International Application No. # PCT/JP2015/059204, dated Oct. 13, 2016 (8 pages).

* cited by examiner

ELECTROSTATIC COATING DEVICE, POWER SOURCE DEVICE FOR ELECTROSTATIC COATING DEVICE AND ELECTROSTATIC COATING METHOD

TECHNICAL FIELD

A first aspect of the present invention relates to an electrostatic coating device, a second aspect of the present invention relates to a power source device for an electrostatic coating device and a third aspect of the present invention relates to an electrostatic coating method.

BACKGROUND ART

The electrostatic coating method sends a coating liquid to a nozzle and applies a high voltage between the nozzle and a counter electrode that supports an object to be coated. The application of a high-voltage charge causes the coating liquid to be charged. Using a potential difference between a distal end of the nozzle and the counter electrode as a trigger, a size of droplets approximate to the nozzle diameter ejecting from the nozzle are split by repulsion of the charge stored in the droplets and the droplets are thereby transformed into atomized minute particles. The atomized coating liquid adheres to the object to be coated which is charged with the polarity opposite to that of the coating liquid on the counter electrode.

CITATION LIST

Patent Literature

Patent Literature 1: Japanese Unexamined Patent Publication No. 2006-58628

Patent Literature 2: Japanese Unexamined Patent Publication No. 2004-136655

SUMMARY OF INVENTION

Technical Problem

When an application of a high voltage is stopped, a discharge time period of several tens of seconds to several minutes is normally required for the applied voltage to be discharged naturally. For this reason, upon completion of the coating, even after the application of the high voltage is stopped, dripping of the coating liquid from the nozzle due to the residual charge does not stop, which may cause a film-forming state to become unstable near a point at which the coating is completed, increasing a possibility that a film-forming error such as a blurred pattern will appear.

The present invention has been implemented in view of the above problem and it is an object of the present invention to provide an electrostatic coating device, a power source device for an electrostatic coating device and an electrostatic coating method capable of completing dripping of the liquid from the nozzle as quickly as possible after power is turned off.

Solution to Problem

A first aspect of the present invention is an electrostatic coating device comprising, a nozzle discharging a liquid to an object to be coated, a counter electrode being disposed in such a way as to face the nozzle and supporting the object to be coated, a power source applying a voltage between the nozzle and the counter electrode, and a switch selectively grounding the nozzle.

According to this configuration, the electrostatic coating device comprising the nozzle that discharges a liquid to an object to be coated, the counter electrode that is disposed in such a way as to face the nozzle and supports the object to be coated and the power source that applies a voltage between the nozzle and the counter electrode further comprises the switch that selectively grounds the nozzle. Since the charge remains in the nozzle even when power is turned off as described above, it takes time to complete dripping of the liquid from the nozzle to the object to be coated. However, when the nozzle is grounded by the switch, the charge remaining in the nozzle goes to the ground and the charge remaining in the nozzle disappears. For this reason, after power is turned off, dripping of the liquid from the nozzle can be completed as quickly as possible.

In this case, the switch may connect the nozzle and the power source when the nozzle is not grounded, and may cut off the connection between the nozzle and the power source when the nozzle is grounded.

According to this configuration, the switch connects the nozzle and the power source when the nozzle is not grounded and cuts off the connection between the nozzle and the power source when the nozzle is grounded. In this way, the cutoff of the connection between the nozzle and the power source and the grounding of the nozzle are performed in synchronization, and therefore upon completion of coating, dripping of the liquid from the nozzle can be completed more smoothly.

The electrostatic coating device may further comprise a liquid supply section receiving power from the power source and thereby supplying the liquid to the nozzle, wherein the switch connects the liquid supply section and the power source when the nozzle is not grounded and cuts off the connection between the liquid supply section and the power source when the nozzle is grounded.

According to this configuration, the electrostatic coating device further comprises the liquid supply section that receives power from the power source and thereby supplies a liquid to the nozzle, and the switch connects the liquid supply section and the power source when the nozzle is not grounded and cuts off the connection between the liquid supply section and the power source when the nozzle is grounded. In this way, the stoppage of a liquid supply to the nozzle section and the grounding of the nozzle are performed in synchronization, and therefore upon completion of coating, dripping of the liquid from the nozzle can be completed more smoothly.

A second aspect of the present invention is a power source device for an electrostatic coating device comprising, a power source applying a voltage between a nozzle discharging a liquid to an object to be coated and a counter electrode being disposed in such a way as to face the nozzle and supports the object to be coated, and a switch selectively grounding the nozzle.

In this case, the switch may connect the nozzle and the power source when the nozzle is not grounded and cut off the connection between the nozzle and the power source when the nozzle is grounded.

The power source may supply power to the liquid supply section supplying the liquid to the nozzle and the switch may connect the liquid supply section and the power source when the nozzle is not grounded and cut off the connection between the liquid supply section and the power source when the nozzle is grounded.

A third aspect of the present invention is an electrostatic coating method comprising a first step of applying a voltage from a power source between a nozzle discharging a liquid to an object to be coated and a counter electrode being disposed in such a way as to face the nozzle and supports the object to be coated and a second step of grounding the nozzle by a switch.

In this case, in the first step, the nozzle and the power source may be connected without grounding the nozzle, and in the second step, the nozzle may be grounded by the switch to cut off the connection between the nozzle and the power source.

In the first step, power from the power source may be supplied to the liquid supply section to thereby cause the liquid supply section to supply the liquid to the nozzle and the liquid supply section may be connected to the power source without grounding the nozzle by the switch, and in the second step, the nozzle may be grounded by the switch to cut off the connection between the liquid supply section and the power source.

Advantageous Effects of Invention

According to the electrostatic coating device according to the first aspect of the present invention, the power source device for an electrostatic coating device according to the second aspect of the present invention and the electrostatic coating method according to the third aspect of the present invention, it is possible to complete dripping of the liquid from the nozzle as quickly as possible after power is turned off.

DESCRIPTION OF EMBODIMENTS

Figure 1:
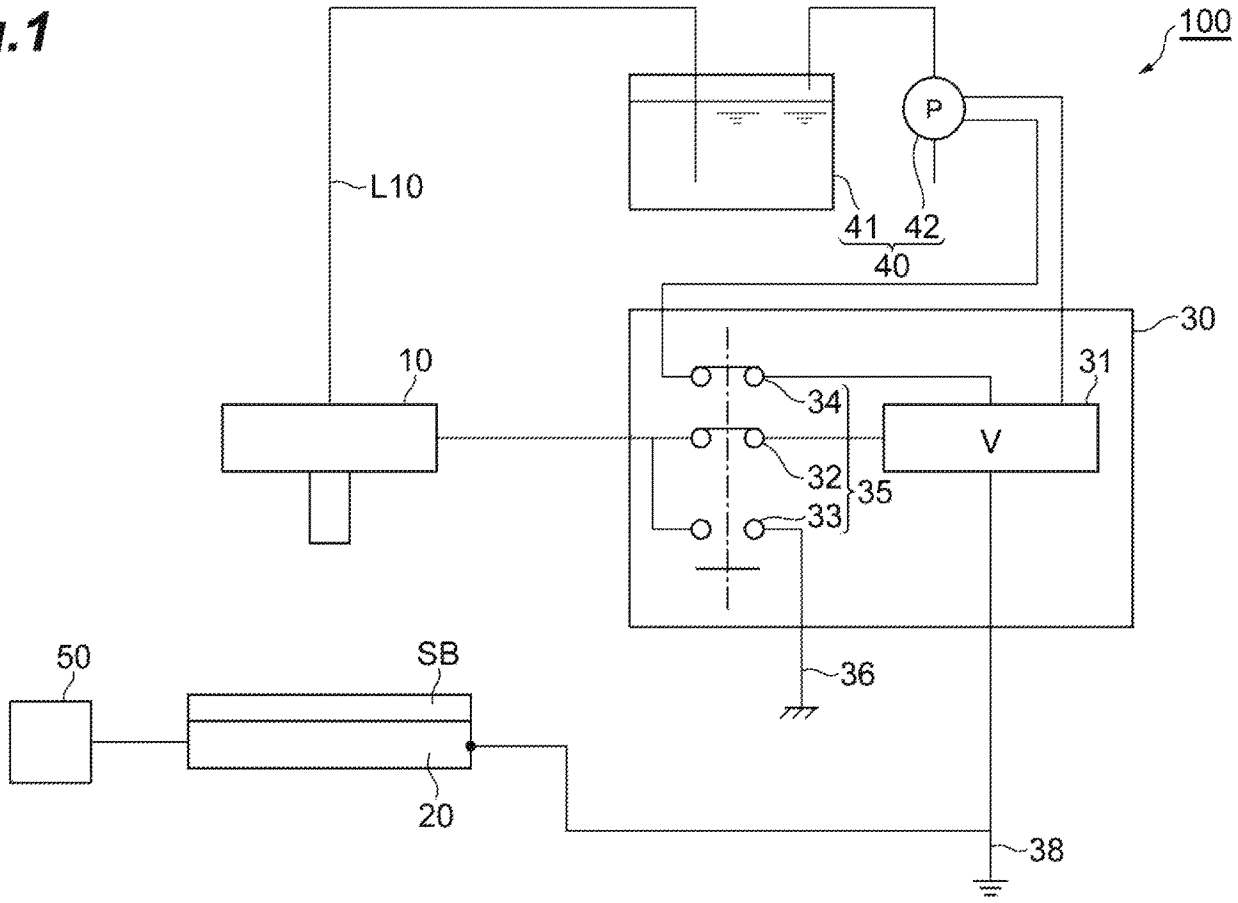
FIG. 1 is a side view illustrating an electrostatic coating device of an embodiment.

An electrostatic coating device, a power source device for an electrostatic coating device and an electrostatic coating method according to an embodiment of the present invention will be described in detail with reference to the accompanying drawings. As shown in FIG. 1, an electrostatic coating device 100 of the present embodiment comprises a nozzle section 10, a counter electrode 20, a power source device 30, a liquid supply section 40 and a counter electrode moving section 50. The nozzle section 10 that constitutes a nozzle of the electrostatic coating device 100 discharges a liquid such as a coating liquid to an object to be coated such as a substrate SB. Part or all of the nozzle section 10 is made of a conductive material such as stainless steel and part or all of an inside surface thereof is formed of a conductive wall. A distal end of the nozzle section 10 is a capillary having an inner diameter of on the order of several tens to several hundreds of μm. The capillary at the distal end of the nozzle section 10 is connected to the power source device 30. The nozzle section 10 receives a supply of a liquid such as a coating liquid from the liquid supply section 40 via a line L10. Note that the material of the nozzle section 10 may be glass.

The counter electrode 20 is disposed in such a way as to face the nozzle section 10. The counter electrode 20 is flat-shaped having a flat surface on a side opposite to the nozzle section 10. The counter electrode 20 serves as a stage that supports the object to be coated such as a substrate SB on the flat surface on the side opposite to the nozzle section 10. The counter electrode 20 is disposed on an extension of an axis of the nozzle section 10 along which a liquid is discharged. The counter electrode 20 is separated from the nozzle section 10. The distance between the nozzle section 10 and the substrate SB is not particularly limited, but the distance may be set to on the order of, for example, 10 to 60 mm. The counter electrode 20 has conductivity. The counter electrode 20 is connected to the power source device 30. The counter electrode 20 is moved by the counter electrode moving section 50 in a direction parallel to a surface of the substrate SB. The counter electrode 20 is grounded via a counter electrode grounding wire 38.

The counter electrode moving section 50 moves the counter electrode 20 relative to the nozzle section 10. More specifically, for example, when the object to be coated is the substrate SB, the counter electrode 20 is moved in two axial directions orthogonal to each other within a plane parallel to the surface of the substrate SB independently of each other. This allows a desired part on the substrate SB to be coated with a liquid such as a coating liquid. Furthermore, the counter electrode moving section 50 may be enabled to move the counter electrode 20 relative to the nozzle section 10 also in a direction perpendicular to the surface of the substrate SB. This makes it possible to adjust the distance between the distal end of the nozzle section 10 and the surface of the substrate SB.

The liquid supply section 40 receives power from the power source device 30 and thereby supplies a liquid such as a resist solution or a coating liquid to the nozzle section 10 via the line L10. The liquid supply section 40 comprises a tank 41 that stores a liquid such as a resist solution or a coating liquid and a pump 42 that supplies the liquid to the nozzle section 10 from the tank 41 via the line L10. The pump 42 is connected to the power source device 30. The pump 42 supplies air to the tank 41 which is in a hermetically sealed state and the liquid is thereby supplied to the nozzle section 10 via the line L10. Note that the liquid supply section 40 may not necessarily supply the liquid using the pump 42. For example, the liquid supply section 40 may consist of an air pulse type dispenser. The air pulse type dispenser is an apparatus that opens/closes an electromagnetic valve for a certain period of time, thereby guides a gas such as $N_2$ whose pressure is reduced by a regulator to a certain pressure into a container such as a syringe in which a liquid material is sealed, and extrudes the liquid material.

In the present embodiment, the liquid supply section 40 supplies, for example, a resist solution to the nozzle section 10. The resist solution is a mixture of resin such as novolac resin, a photosensitive agent such as naphtho diazide and a solvent such as PGMEA (propylene glycol methyl ether acetate). A viscosity range of the resist solution is 5 to 1000 mPa·s. Examples of the resist include NPR3510 manufactured by Nagase ChemteX Corporation.

The power source device 30 applies a voltage between the nozzle section 10 and the counter electrode 20. The power source device 30 supplies power to the pump 42 of the liquid supply section 40. The power source device 30 comprises a high-voltage power source section 31 and an instantaneous stop circuit 35. The high-voltage power source section 31 applies a voltage between the nozzle section 10 and the counter electrode 20. The voltage applied by the high-voltage power source section 31 is normally a direct current and may be supplied in, for example, a pulsating form. The voltage applied between the nozzle section 10 and the counter electrode 20 is not particularly limited, but in the present embodiment, it can be set to 5 to 20 kV. The voltage may be applied so that the nozzle section 10 side becomes a positive side with respect to the counter electrode 20. The high-voltage power source section 31 supplies power to the pump 42 of the liquid supply section 40 at a predetermined voltage. The voltage applied to the pump 42 can be a rated voltage of the pump 42.

The instantaneous stop circuit 35 that constitutes the switch of the electrostatic coating device 100 comprises a high-voltage power source section-side relay switch 32, a grounding wire-side relay switch 33 and a pump-side relay switch 34. The instantaneous stop circuit 35 selectively grounds the nozzle section 10. In the present embodiment, since the voltage applied between the nozzle section 10 and the counter electrode 20 by the high-voltage power source section 31 is a high voltage, the instantaneous stop circuit is configured by combining the three relay switches instead of a normal relay switch with a C contact point. The high-voltage power source section-side relay switch 32 opens/closes a contact point for connecting the high-voltage power source section 31 and the nozzle section 10. The grounding wire-side relay switch 33 opens/closes a contact point for connecting the nozzle section 10 and the nozzle section grounding wire 36. The pump-side relay switch 34 opens/closes a contact point for connecting the high-voltage power source section 31 and the pump 42.

When the nozzle section 10 is not grounded to the nozzle section grounding wire 36 by turning off the grounding wire-side relay switch 33, the instantaneous stop circuit 35 turns on the high-voltage power source section-side relay switch 32 to connect the nozzle section 10 and the high-voltage power source section 31, and turns on the pump-side relay switch 34 to connect the pump 42 and the high-voltage power source section 31.

On the other hand, when turning on the grounding wire-side relay switch 33 to ground the nozzle section 10 to the nozzle section grounding wire 36, the instantaneous stop circuit 35 turns off the high-voltage power source section-side relay switch 32 to cut off the connection between the nozzle section 10 and the high-voltage power source section 31, and turns off the pump-side relay switch 34 to cut off the connection between the pump 42 and the high-voltage power source section 31.

Hereinafter, operation of the electrostatic coating device 100 and the electrostatic coating method using the electrostatic coating device 100 according to the present embodiment will be described.

First, the substrate SB which becomes an object to be coated is placed on the counter electrode 20. As the first step, the high-voltage power source section-side relay switch 32 and the pump-side relay switch 34 of the instantaneous stop circuit 35 are turned on and the grounding wire-side relay switch 33 is turned off. Thus, the high-voltage power source section 31 and the nozzle section 10 are connected, the pump 42 of the liquid supply section 40 and the high-voltage power source section 31 are connected, and the connection between the nozzle section 10 and the nozzle section grounding wire 36 is cut off.

The power source device 30 applies a voltage between the capillary at the distal end of the nozzle section 10 and the counter electrode 20, and the pump 42 is driven and the liquid in the tank 41 is supplied to the nozzle section 10 via the line L10. The nozzle section 10 gives a charge to the liquid and the liquid is thereby charged. The liquid discharged from the nozzle section 10 forms a conic Taylor cone. At a vertex of the Taylor cone, droplets are Rayleigh-split by an electrostatic force and many minute droplets are discharged toward the counter electrode 20 which has a charge with a polarity opposite to that of the droplets. The counter electrode moving section 50 moves the counter electrode 20 toward a moving direction D. In this way, the whole surface of the substrate SB supported on the counter electrode 20 is coated with the liquid.

When the electrostatic coating is completed, the high-voltage power source section-side relay switch 32 and the pump-side relay switch 34 of the instantaneous stop circuit 35 are turned off as the second step, and the grounding wire-side relay switch 33 is turned on. Thus, the connection between the high-voltage power source section 31 and the nozzle section 10 is cut off, the connection between the pump 42 of the liquid supply section 40 and the high-voltage power source section 31 is cut off, and the nozzle section 10 and the nozzle section grounding wire 36 are connected. In this way, the nozzle section 10 is grounded.

Figure 3A:
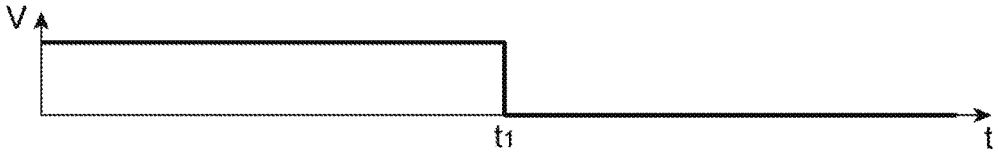
FIG. 3(*a*) is a graph illustrating transition of a voltage of a power source device of a conventional electrostatic coating device and FIG. 3(*b*) is a graph illustrating transition of a voltage of a nozzle section of a conventional electrostatic coating device.
Figure 3B:
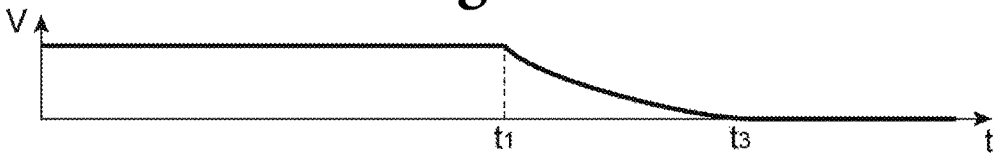

Even when the voltage of the power source device 30 is turned off at a time $t=t_1$ as shown in FIG. 3(*a*), the charge with which the nozzle section 10 is charged in the conventional electrostatic coating device is naturally discharged as shown in FIG. 3(*b*), and a discharge time of a time $t=t_3-t_1$ is required until the voltage of the nozzle section 10 becomes 0. Thus, even after the application of a high voltage is stopped upon completion of coating, dripping of the coating liquid from the nozzle section 10 due to the residual charge does not stop, and the film-forming state in the vicinity of the coating completing point may become unstable, increasing a possibility that a film-forming error such as a blurred pattern will appear.

Figure 2A:
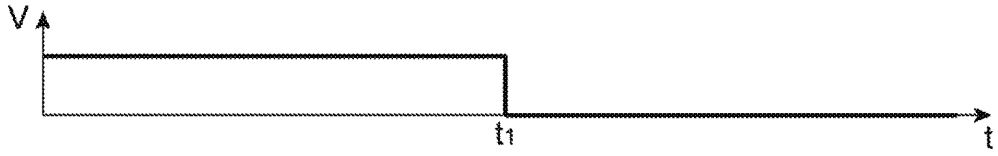
FIG. 2(*a*) is a graph illustrating transition of a voltage of a power source device of the electrostatic coating device of the embodiment and FIG. 2(*b*) is a graph illustrating transition of a voltage of a nozzle section of the electrostatic coating device of the embodiment.
Figure 2B:
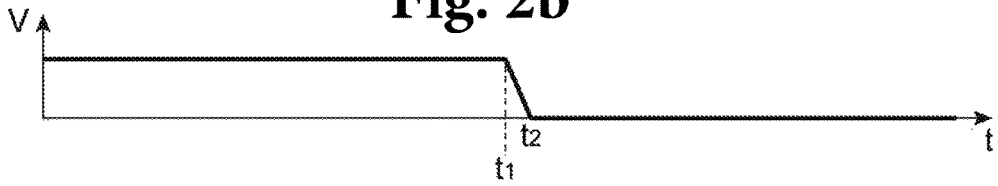

On the other hand, in the present embodiment, as shown in FIG. 2(*a*), when the voltage of the power source device 30 is turned off at a time $t=t_1$, the charge with which the interior of the nozzle section 10 is charged upon completion of coating is instantaneously removed via the nozzle section grounding wire 36 as shown in FIG. 2(*b*), and therefore only a time $t=t_2-t_1<t_3-t_1$ is required until the voltage of the nozzle section 10 becomes 0. For this reason, it is possible to prevent dripping of the coating liquid from the nozzle section 10 from continuing upon completion of coating and make more stable the film-forming state near the coating completing point.

Moreover, in the present embodiment, the instantaneous stop circuit 35 connects the nozzle section 10 and the high-voltage power source section 31 when the nozzle section 10 is not grounded and cuts off the connection between the nozzle section 10 and the high-voltage power source section 31 when the nozzle section 10 is grounded. Thus, the cutoff of the connection between the nozzle section 10 and the high-voltage power source section 31 and the grounding of the nozzle section 10 are performed in synchronization, and it is thereby possible to more smoothly complete dripping of the liquid from the nozzle section 10 upon completion of coating.

Furthermore, in the present embodiment, the instantaneous stop circuit 35 connects the liquid supply section 40 and the high-voltage power source section 31 when the nozzle section 10 is not grounded, and cuts off the connection between the liquid supply section 40 and the high-voltage power source section 31 when the nozzle section 10 is grounded. Thus, the stoppage of a liquid supply to the nozzle section 10 and the grounding of the nozzle section 10 are performed in synchronization, and it is thereby possible to more smoothly complete dripping of the liquid from the nozzle section 10 upon completion of coating.

Note that the electrostatic coating device, the power source device for an electrostatic coating device and the electrostatic coating method according to the embodiment of the present invention are not limited to the above embodiment, but it goes without saying that various modifications can be made without departing from the spirit and scope of the embodiment of the present invention. For example, the power source that applies a voltage between the nozzle section 10 and the counter electrode 20 may be different from the power source that supplies power to the liquid supply section 40. In this case, the apparatus can be configured in such a way that when the power source that applies a voltage between the nozzle section 10 and the counter electrode 20 is turned on, the power source that supplies power to the liquid supply section 40 is also turned on, and when the power source that applies a voltage between the nozzle section 10 and the counter electrode 20 is turned off, the power source that supplies power to the liquid supply section 40 is also turned off.

INDUSTRIAL APPLICABILITY

According to the electrostatic coating device according to the first aspect of the present invention, the power source device for an electrostatic coating device according to the second aspect of the present invention and the electrostatic coating method according to the third aspect of the present invention, it is possible to complete dripping of the liquid from the nozzle as quickly as possible after power is turned off.

REFERENCE SIGNS LIST

10 . . . nozzle section, 20 . . . counter electrode, 30 . . . power source device, 31 . . . high-voltage power source section, 32 . . . high-voltage power source section-side relay switch, 33 . . . grounding wire-side relay switch, 34 . . . pump-side relay switch, 35 . . . instantaneous stop circuit, 36 . . . nozzle section grounding wire, 38 . . . counter electrode grounding wire, 40 . . . liquid supply section, 41 . . . tank, 42 . . . pump, 50 . . . counter electrode moving section, 100 . . . electrostatic coating device, L10 . . . line, SB . . . substrate

The invention claimed is:

1. An electrostatic coating device comprising:

a nozzle that discharges a liquid to an object being coated;

a counter electrode that is disposed to face the nozzle and to support the object being coated;

a power source that applies a voltage between the nozzle and the counter electrode;

a switch that selectively grounds the nozzle; and a liquid supply section that receives power from the power source and thereby supplies the liquid to the nozzle, wherein the switch connects the liquid supply section and the power source when the nozzle is not grounded and cuts off the connection between the liquid supply section and the power source if the nozzle is grounded.

2. The electrostatic coating device according to claim 1, wherein the switch connects the nozzle and the power source when the nozzle is not grounded, and cuts off the connection between the nozzle and the power source when the nozzle is grounded.

3. An electrostatic coating device comprising:

a nozzle that discharges a liquid to an object being coated;

a counter electrode that is disposed to face the nozzle and to support the object being coated;

a power source that applies a voltage between the nozzle and the counter electrode; and a switch that selectively grounds the nozzle, wherein the switch connects the nozzle and the power source when the nozzle is not grounded, and cuts off the connection between the nozzle and the power source when the nozzle is grounded, wherein the electrostatic coating device further comprises a liquid supply section that receives power from the power source and thereby supplies the liquid to the nozzle, and wherein the switch connects the liquid supply section and the power source when the nozzle is not grounded and cuts off the connection between the liquid supply section and the power source when the nozzle is grounded.

* * * * *